US007740123B2

(12) United States Patent
López Fernández et al.

(10) Patent No.: US 7,740,123 B2
(45) Date of Patent: Jun. 22, 2010

(54) PACKAGING AND SUPPLY DEVICE FOR GROUPING PRODUCT ITEMS

(75) Inventors: Marion Janet López Fernández, Düsseldorf (DE); Carsten Dalsgaard Bech, Euskirchen (DE); André Mellin, Düsseldorf (DE)

(73) Assignee: The Procter & Gamble Company, Cincinnati, OH (US)

( * ) Notice: Subject to any disclaimer, the term of this patent is extended or adjusted under 35 U.S.C. 154(b) by 97 days.

(21) Appl. No.: 12/105,715

(22) Filed: Apr. 18, 2008

(65) Prior Publication Data

US 2008/0276574 A1 Nov. 13, 2008

(30) Foreign Application Priority Data

May 11, 2007 (EP) ..... 07009467

(51) Int. Cl.
*B65G 47/26* (2006.01)

(52) U.S. Cl. ..... 198/418.5; 198/426; 198/431; 198/457.01; 198/626.1; 53/537; 53/541; 53/543

(58) Field of Classification Search ..... 198/418.5, 198/426, 429, 430, 431, 457.01, 626.1, 626.5; 53/537, 541, 543; 414/793.4–793.7
See application file for complete search history.

(56) References Cited

U.S. PATENT DOCUMENTS 2,014,458 A * 9/1935 Winkley ..... 198/426
2,324,930 A * 7/1943 Joa ..... 53/537
2,825,475 A 3/1958 Roberts
3,340,992 A * 9/1967 Seragnoli ..... 198/347.3
3,360,100 A * 12/1967 Seragnoli ..... 198/347.3
3,499,555 A * 3/1970 Wahle ..... 198/347.3
3,794,154 A 2/1974 Holt
3,954,165 A * 5/1976 Snyder ..... 198/418.4
4,220,236 A 9/1980 Blidung et al.

(Continued)

FOREIGN PATENT DOCUMENTS

EP 0 061 631 11/1985

OTHER PUBLICATIONS

PCT International Search Report mailed Jun. 10, 2008.

*Primary Examiner*—Mark A Deuble
(74) *Attorney, Agent, or Firm*—Betty J. Zea

(57) ABSTRACT

A packaging device for grouping product items, especially semi-soft tissue paper packs (7), to a bundle of layered rows (L1, L2, L3) of said product items (7) having a supply line (1) including a main conveyor belt (5) constituently carrying and supplying a stream of product items (7) in a defined orientation along an infeed main path (6) to a transfer position (18), an elevator means (2) having a plurality of stack-forming receptacles (23) each receiving a grouped row (L1, L2, L3) of a specified number of said product items (7) in a chopped manner from the transfer position of said supply line (1) at an input end of the elevator means (2), wherein the elevator means (2) is adapted to successively displace the stacked grouped rows of product items (7) in a side-by-side relationship orthogonally to the infeed main path (6) to an output end of the elevator means (2), and an outfeed unit (3) engaging with the elevator means (2), commonly removing a specified number stacked grouped rows (L1, L2, L3) of said product items (7) in the side-by-side relationship from the output end of the elevator means (2) to form said bundle of product items (7).

9 Claims, 4 Drawing Sheets

U.S. PATENT DOCUMENTS 4,399,905 A * 8/1983 Lance et al. ..... 198/430
4,499,987 A * 2/1985 Long ..... 198/347.3
5,113,992 A * 5/1992 Sadamori ..... 198/347.3
5,271,489 A * 12/1993 Helmstetter ..... 198/347.1
5,584,477 A * 12/1996 Sakai ..... 271/198
6,164,045 A 12/2000 Focke et al.
6,931,823 B2 * 8/2005 Forte et al. ..... 53/528
7,156,607 B2 * 1/2007 Anderson et al. ..... 414/790
2006/0288661 A1 12/2006 Allwein

* cited by examiner

PACKAGING AND SUPPLY DEVICE FOR GROUPING PRODUCT ITEMS

FIELD OF THE INVENTION

The invention refers to a packaging device for grouping product items, especially semi-soft tissue paper packs, to a bundle of layered rows of said product items and a supply device especially for use with such a packaging device.

BACKGROUND OF THE INVENTION

In commerce especially as concerns mass products of daily use it is a common problem to pack product items as the above mentioned tissue paper packs to bundles of e.g. two layers of three up to five packs (i.e. six to ten packs per bundle), three layers of four up to six packs (i.e. twelve to 24 packs per bundle) or four layers of six to eight packs (i.e. 24 to 32 packs per bundle).

In some existing packaging devices, the single product items are supplied in a stream and fed into a transverse pushing mechanism, which collects e.g. four subsequent packs pushing them transversally to the incoming stream of product items. In a laterally displaced position these four collected product items fall into a receptacle. Upon this first layer of four items a second and a third layer are pushed by said transverse pushing mechanism thus grouping twelve packs in three layers of four product items in a bundle.

This type of existing packaging device, above, may suffer from several disadvantages. First, during the transversal, pushing of the group of product items the infeed process to the transverse pushing mechanism may be interrupted. For example, only after the group of product items has fallen into the receptacle the next group of items can be supplied to the transverse mechanism. This is a first limit to the overall handling capacity of this packaging device.

A second problem is the fact that the product items from the transverse pushing mechanism fall into a receptacle. This means that during a certain period of the packaging action the products are merely under the influence of gravity. The handling speed and acceleration of the product items is naturally bounded under the influence of gravity. Finally, the product items just fall into the receptacle, thus control may be lacking for the product items, and makes the process vulnerable to disturbances and even breakdowns of the packaging device.

In the field of packaging techniques, other references relate to the grouping, stacking, layering etc. of product items. For example U.S. Pat. No. 6,164,045 discloses a device for packaging groups, i.e. layers, of packages in a carton or the like, wherein product items individually arriving in a supply stream are collected in an area of the grouping station so as to form rows of packages. The latter may be again pushed off in the transverse direction by a transverse slide onto a collecting plate in order to establish layers comprising a plurality of rows of packages. The complete layers are handled by a lifting conveyor and delivered to a carton.

Aforesaid device for packaging groups may suffer from some of the same disadvantage as discussed above, namely that during the transverse stroke of the transverse slide no new product items can be loaded into the transverse slide thus limiting the capacity of the device.

Further, EP 0 061 631 A1 and U.S. Pat. No. 2,825,475 refer to the problem of layering flat products, like rigid, semi-rigid or flexible sheet-like elements, for example paper handkerchiefs. Both publications disclose elevator means comprising two counter-rotating crawler-like tracks each provided with support elements onto which successively sheet-like elements coming from a feeding group can be discarded. Thus on each pair of support elements on the crawler-like tracks a stack of sheet-like elements may be formed.

SUMMARY OF THE INVENTION

The invention herein provides a packaging device for grouping product items, especially semi-soft tissue paper packs, to a bundle of layered rows of said product items and a supply device especially to be used in conjunction with such a packaging device, which due to their construction allow an increased handling speed and improved control about the product items thus enabling a substantially higher capacity of the packaging device or any other handling device for product items, which the supply device cooperates with.

The packaging device comprises:

- a supply line including a main conveyor belt constituently carrying and supplying a stream of product items in a defined orientation along an infeed main path to a transfer position,
- an elevator means including a plurality of stack-forming receptacles each receiving a grouped row of a specified number of said product items in a chopped manner from the transfer position of said supply line at an input end of the elevator means, wherein the elevator means is adapted to successively displace the stacked grouped rows of product items in a side-by-side relationship orthogonally to the infeed main path to an output end of the elevator means, and
- an outfeed unit engaging the elevator means, commonly removing a specified number of layers of stacked grouped rows of said product items in the side-by-side relationship from the output end of the elevator means to form said bundle of product items.

The supply device according to the invention comprises:

- a main conveyor belt constituently carrying and supplying a stream of product items in a defined orientation along an infeed main path to a transfer position for supplying a grouped row of product items in a chopped manner from the transfer position to a following stage, and
- an infeed assembly at the end of the supply line comprising:
  - an infeed conveyor belt to transport the grouped row of product items, which infeed conveyor belt is controlled by a stepper motor, is located above the infeed main path and is advancable against the row of product items to bias the row of product items from above against the main conveyor belt at least during the transport of the grouped row of product items, and
  - a stopper means engagable into the infeed main path to hold and release the grouped row of product items in and from the transfer position at the end of the supply line in a manner synchronized with the infeed conveyor belt.

This concept of the packaging and supply device leads to several advantages. First of all, in an embodiment, the whole grouping and bundling process in the packaging device is free from any influences of gravitation as the product items in each state of the packaging device are handled and guided in a defined manner by according elements of the packaging device, like the infeed main path in the supply line and especially the receptacles in the elevator means. Secondly due to the successive displacement of the stacked grouped rows of product items in the elevator means in a side-by-side relationship it is possible to "load" product items incoming along the infeed main path to an according receptacle at the input end of the elevator means concurrently with the removal of a bundle of product items by the outfeed unit of the packaging device at the output end of the elevator means. Thus in an embodiment loading and removing product items are basically decoupled processes. Inasmuch minimal or no delay is generated as may be the situation with prior grouping and bundling devices discussed above due to the transverse pusher used there.

As concerns the supply device due to the specific construction with an infeed assembly comprising a stepper motor controlled infeed conveyor belt which is selectively advancable versa the product items and a stopper means a significantly controlled handling management at high supply speeds is achieved for the product items.

The features and advantages of the packaging and supply device, are broadly explained and discussed in the following description of an embodiment of the invention in connection with the accompanying drawings.

DETAILED DESCRIPTION OF THE INVENTION

Figure 1:
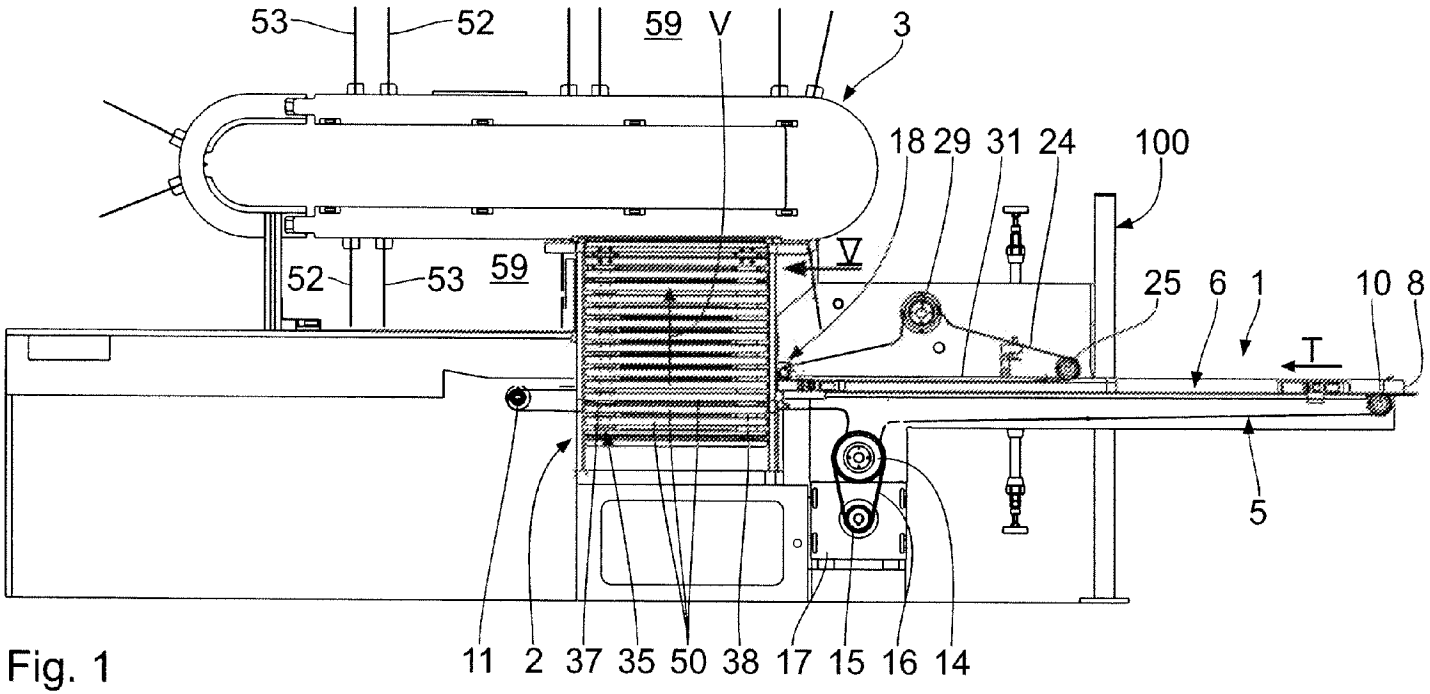
FIGS. 1 and 2 are a schematic side elevation and top view of a packaging device together with an outfeed conveyor.
Figure 2:
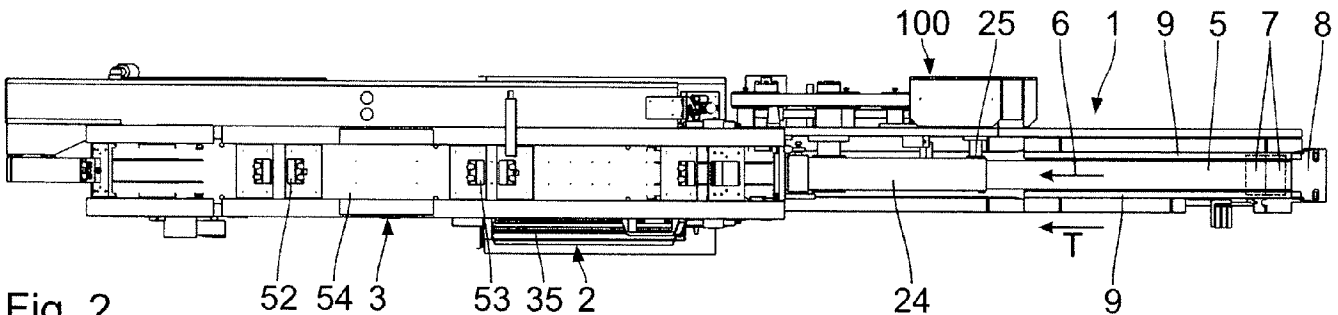

As can be seen from FIGS. 1 and 2 the packaging device comprises three main portions which are a supply line 1, an elevator means 2 and an overhead outfeed unit 3. The latter is followed by optionally, an outfeed conveyor which is no part of the present invention.

All machine elements as they are explained in the following are attached to and supported by a multi-part machine frame generally depicted by the reference numeral 100. The specific construction of the machine frame 100 is adapted to the general function and constructive details of the elements of the packaging device.

Figure 3:
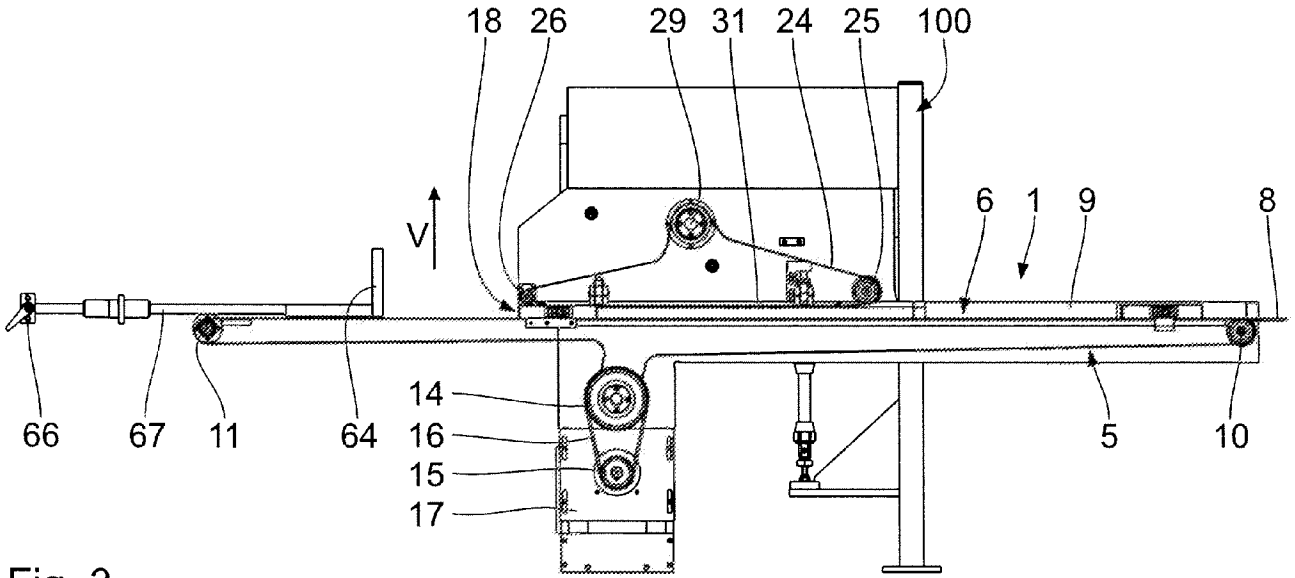
FIG. 3 is a side elevation of the supply line of the packaging device of FIG. 1.
Figure 4:
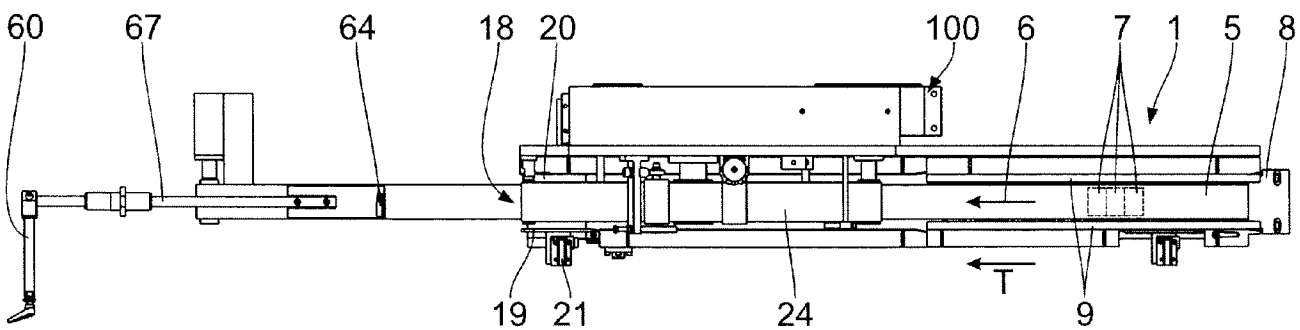
FIG. 4 is a top view of the supply line according to FIG. 3.

The supply line 1 as it is shown in more detail in FIGS. 3 and 4 includes a main conveyor belt 5 which constituently carries and supplies a stream of e.g. cuboid-shaped semi-soft tissue paper packs 7 for as a rule ten tissue handkerchiefs in a defined orientation along its infeed main path 6. The packs 7 lie flat on one of their main surfaces with their longitudinal axis directed transversally to the infeed main path 6.

The packs arrive at the one end 8 in a loose series and are thus taken over by the main conveyor belt 5 and, generally, are transported along the infeed main path 6 on the main conveyor belt 5 in a transport direction T guided by lateral rails 9 beneath the main conveyor belt 5.

The main conveyor belt 5 itself is running over two deflection pulleys at the cited end 8 of the supply line 1 and the opposite end 12, respectively. Furtheron there are provided tensioning pulleys and a drive pulley 14 over which the main conveyor belt 5 is led. The drive pulley 14 is coupled via a belt pulley 15 and a toothed belt 16 to a stepper motor 17 driving the main conveyor belt 5 in a controllable and variable manner.

As the packs 7 to be bundled arrive in a loose series at the end 8 of the infeed main path 6 it is necessary to form a gapless tight row of packs 7 before forming a bundle of layered rows of said packs 7. For this purpose, the incoming packs 7 are somewhat collected at a transfer position indicated by the reference numeral 18 at the end of the infeed main path 6. To realize the collection of the packs 7 there are stopper means in the transfer position 18 which are embodied by two laterally displaceable tong-like clamping plates 19, 20 adjacent the infeed main path 6. These clamping plates 19, 20 are movable in a direction transversally to the transport direction 7 by means of pneumatical piston cylinder drives 21 between a release position and a clamping position. In the release position the clamping plates 19, 20 are moved away from each other, whereas in the clamping position the clamping plates 19, 20 are moved towards each other fixing the packs 7 lying between them. Due to this stopper means the packaging device provides for a gapless row of packs 7 in the portion of the infeed main path 6 leading to the transfer position 8.

Now starting from the transfer position 18 it is necessary to supply a grouped row of e.g. four packs into one receptacle 23 (to be explained below) of the elevator means 2. For this purpose the supply line 1 is provided with an infeed assembly which further to the clamping plates 19, 20 with piston-cylinder-drive 21 comprise an additional infeed conveyor belt 24 which is located above the infeed main path 6. Due to two deflection pulleys 25, 26 one portion of the infeed conveyor belt 24 runs parallel to the main conveyor belt 5 above the same. The remaining part of the infeed conveyor belt 24 is led over tensioning pulleys and a drive pulley 29 which itself is coupled to the drive of the main conveyor belt 5. Accordingly the main conveyor belt 5 and the infeed conveyor belt 24 are driven in absolute synchronism by the stepper motor 17.

The deflection pulleys 25, 26 are located at such an elevation that the distance between the main conveyor belt 5 and the infeed conveyor belt 24 is basically larger than the height of the packs 7 being transported on the main conveyor belt 5. Accordingly in an embodiment it is necessary to include means that the infeed conveyor belt 24 can contact the packs 7 and push same into the respective receptacle 23 of the elevator means 2. For this purpose above the horizontal portion of the infeed conveyor belt 24 there is provided a horizontally positioned downholder bar 31 which is advancable against the infeed conveyor belt 24 from above to press same down onto the packs 7 being collected in the transfer position 18 of the infeed main path 6. The vertical displacement of the horizontal downholder bar 31 is provided by in an embodiment a pneumatic piston-cylinder-drive.

The process of handling packs 7 by the main conveyor belt 5, infeed conveyor belt 24 and downholder bar 31 is explained below.

Figure 6:
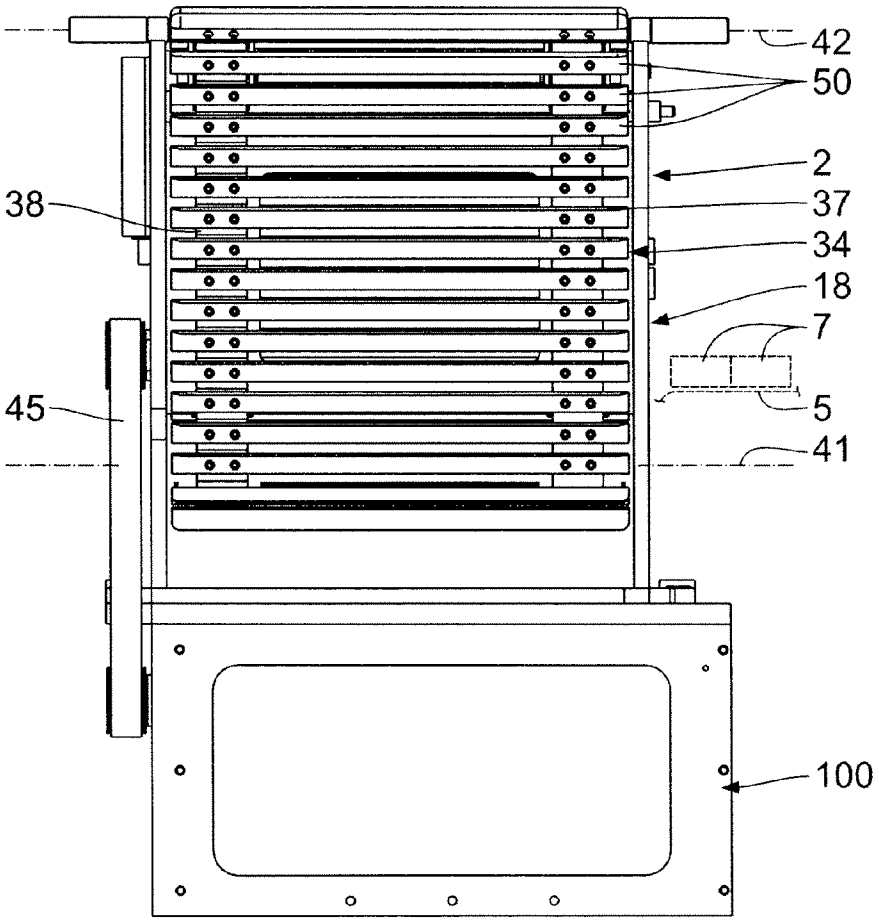
FIG. 6 is a side elevation of the elevator means according to line of vision VI in FIG. 5, and FIGS. 7 and 8 are side elevation and top view of the outfeed unit of the packaging device.
Figure 5:
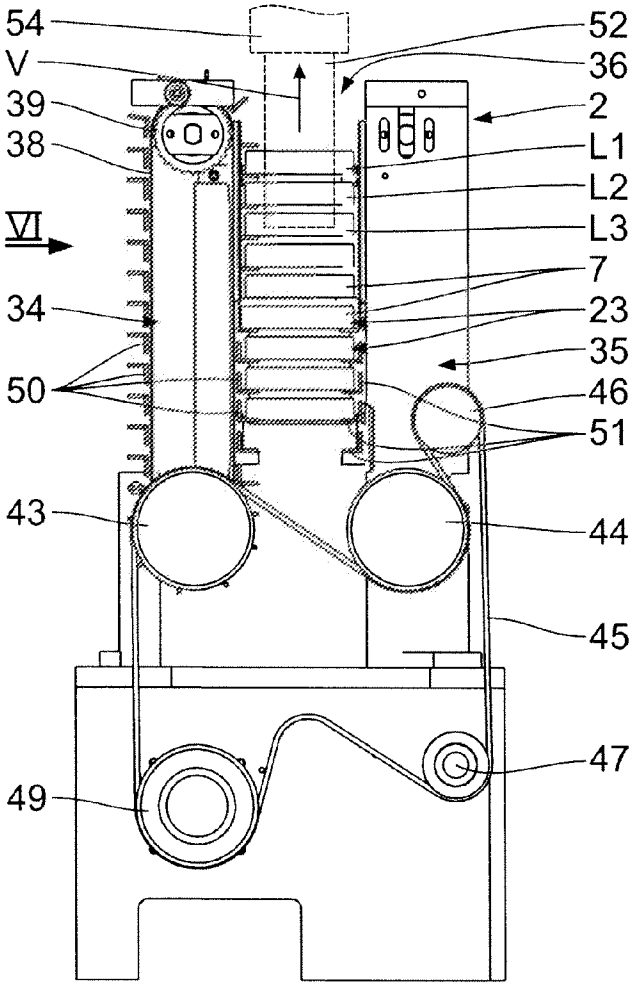
FIG. 5 is a side elevation of the elevator means according to line of vision V in FIG. 1.
Figure 7:
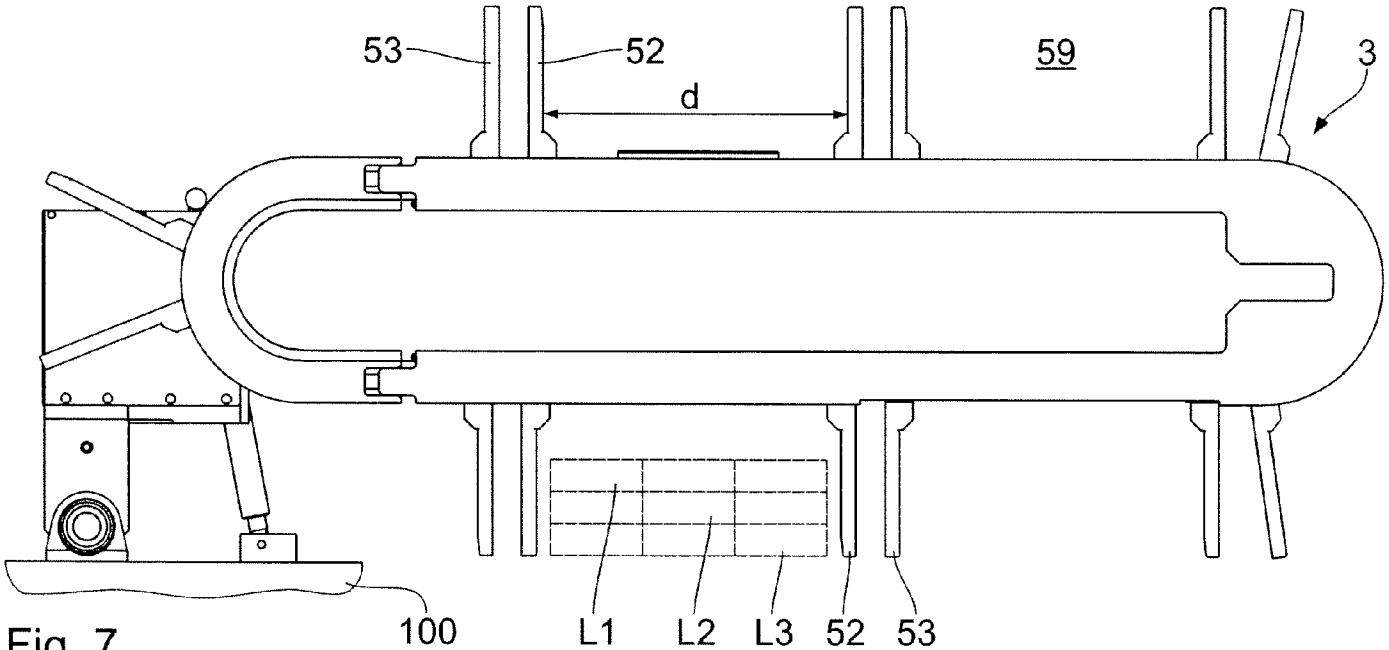

Following the supply line 1 up to the transfer position 18 the elevator means 2 is located which is shown in FIGS. 5 and 6 in greater detail. The elevator means 2 comprises two parallel, endless conveyor units 34, 35 which basically extend in vertical direction and parallel to the transport direction T leaving a space 36 between them, the width of which accords to the transversal dimension of the packs 7 delivered via the infeed main path 6 of the supply line 1. Each conveyor unit 34, 35 comprises two endless conveyor belts 37, 38 running over deflection pulleys 39, 40 at the bottom and top of the conveyor units 34, 35 and being driven in synchronism by a drive. The deflection pulleys 39, 40 are supported on horizontal axes 41, 42 running parallel to the transport direction T. These axes 41, 42 are depicted in dashed lines in FIG. 6. The lower axes 41 are provided with gear wheels 43, 44 upon which an endless gear belt 45 runs. This gear belt 45 is led over deflection pulleys 46, 47 and a drive pulley 49 which is connected to a stepper motor in the machine frame 100.

The conveyor belts 37, 38 of each conveyor unit 34, 35 are provided with angled rails 50, 51 which are equidistantly arranged in a horizontal direction parallel to the transport direction T. Furtheron the rails 50, 51 on the conveyor belts 37, 38 of both conveyor units are positioned on the same vertical level, thus a pair of rails 50, 51 forms the receptacle 23 for a grouped row of packs 7. The rails 50, 51 have a mutual vertical distance which is slightly larger than the height of the packs 7. Thus in the elevator means 2 in successive pairs of rails 50, 51 the grouped rows of packs 7 are transported in vertical direction V in a layered manner from the input end at the bottom of the elevator means 2 to the output end near the top of the elevator means 2.

Figure 8:
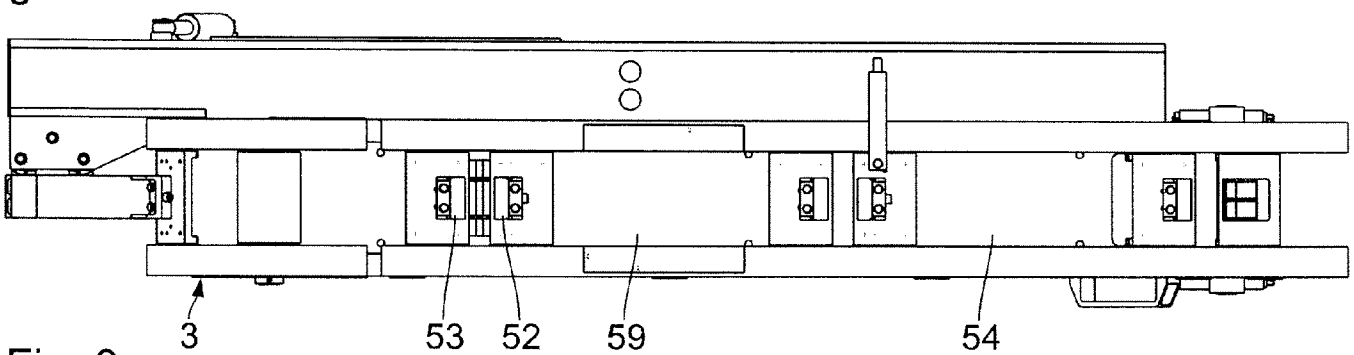

There the outfeed unit 3 engages the elevator means 2 to remove a specified number of layers, e.g. the uppermost three layers of grouped rows of packs 7 parallel to the transport direction T to the outfeed conveyor 4 depicted in FIG. 1. For this purpose the outfeed unit 3 comprises a plurality of first and second pusher blades 52, 53 which are alternatingly attached to the respective one of endless conveyor belts, which are schematically outlined as 54 in FIG. 8.

As is depicted by dashed lines in FIG. 5 the pusher blades 52, 53 at the lower portion of the conveyor belts 54, 55 extend into the space 36 between the conveyor belt units 34, 35 and the rails 50, 51 thus being able to push out the uppermost layers of grouped rows of packs 7. This bundle of packs 7 is located in the compartment 59 which is formed by the respective first and second pusher blade 52, 53. Due to this accommodation of the bundle of packs 7 being formed by a specified number of layers L1, L2, L3 of grouped rows of packs 7 is effectively controlled.

To adjust the mutual distance d between the first and second pusher blades 52, 53 to adapt same to a specific number of packs to be grouped in one row, the two conveyor belts supporting the respective pusher blades 52, 53 can be displaced against each other by a given spacing according to the dimension of the packs 7 parallel to the transport direction T, i.e. the distance is adjustable to e.g. 3 or 4 or 5 times of the width of the packs 7.

In the following the grouping of packs 7 to layered rows to form a bundle is explained in an example. It is assumed that a bundle of packs 7 with four items in a row and three layers L1, L2, L3 should be generated for a package of twelve handkerchiefs. The explanation starts at the supply line 1 where in the transfer position a row of packs 7 is available. The leading pack 7 next to the elevator means 2 and the following packs 7 are held in place by the stopper means in the shape of the clamping plates 19, 20 which are advanced against each other. In this state the downholder bar 31 is in its upper position, accordingly, the main conveyor belt 5 and the infeed conveyor belt 24 idle sliding along the packs 7 being stored in the infeed main path 6 where the packs 7 are wrapped into a foil with a relatively slippery surface.

In this state one of the receptacles 23 of the elevator means 2 is positioned following the transport position 18. To feed the specified four packs 7 into this receptacle simultaneously the downholder bar 31 is advanced onto the infeed conveyor belt 24 and the clamping plates 19, 20 are retracted. Thus the row of packs 7 are "shot" into the receptacle 23, however, the stepper motor 17 is controlled in a way that the movement of the row of packs 7 is slowed down at the end of the infeed strike. Simultaneously within the space 36 between the conveyor belt units 34, there is positioned an adjustable stop 64 shaped as an erected plate. The distance d between the stop 34 and the transfer position 18 equals to the measure of, in this case, four packs 7 in a row.

When the receptacle 23 is filled with the four packs 7 the clamping plates 19, 20 engage the infeed main path 6 again thus holding the packs 7 again. Simultaneously the downholder bar 31 is retracted upwards and the main conveyor belt 5 and infeed conveyor belt 25 are accelerated to their full speed again, but are idling relative to the packs 7 again. Furtheron the elevator means 2 is operated to position the next empty receptacle 23 in front of the transport position 18 for the next filling step introducing another four packs 7 into the elevator means. These filling cycles repeat in a kind that the receptacles 23 are filled and elevated in a chopped manner, i.e. filling and elevating takes place with a somewhat clocked kind of process.

The rows of four packs 7 being lifted up in the elevator means 2 reach the output end of the elevator means 2. As soon as the specified number of layers L1, L2, L3, i.e. three in this example, is located in the respective compartment between the first and second pusher blades 52, 53 of the outfeed unit 3 the latter is operated and pushes out that bundle of three layers L1, L2, L3 of rows of four packs 7.

An example of another bundle format, i.e. four layers of rows of six packs 7, i.e. a bundle of 24 packs 7, there are only a few adaptation steps necessary. First of all the control of the stepper motor 17 for the main conveyor belt 5, infeed conveyor belt 24 and the downholder bar 31 on the one hand and the timing of the clamping plates 19, 20 on the other hand have to be adapted so that six packs 7 are fed into a receptacle 23 of the elevator means 2. This can easily be done by software means in the control of the stepper motor 17.

Along with this the position of the stop 64 is to be changed. For this it is only necessary to open the fixation knob 66 for the support rod 67 of the stop 64 and displace the stop 64 by the width of two packs 7 in transport direction T. Thus in each receptacle 23 six packs 7 are accommodated.

Furtheron the control of the outfeed unit 3 must be changed, e.g., again by software means, to the effect that the outfeed unit 3 waits until four layers of rows of packs 7 have entered the compartment 59 between two pusher blades 52, 53. After that the outfeed unit 3 is operated to remove a bundle of four layers of rows of six packs 7, i.e. a bundle of 24 packs 7.

Aforementioned steps can be accomplished relatively quickly. Accordingly the packaging device according to the invention is very flexible as concerns changing the bundle format.

Furtheron the speed of the machine can be enhanced, due to the handling of the packs by means of the main conveyor belt 5 and the infeed conveyor belt 24 together with the stop 64 a controlled but very fast "shooting-in" of the packs 7 into the receptacle 23 may be accomplished. Finally the infeed process between the supply line and the elevator means on the one hand and the outfeed process from the elevator means 2 with the help of the outfeed unit 3 on the other hand are more or less independent from each other. Thus the packs can be filled in at the input end of the elevator means 2, whereas simultaneously bundles of packs can be removed at the output end of the elevator means 2.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Packaging device for grouping product items to a bundle of layered rows of said product items, comprising:

a supply line comprising a main conveyor belt constituently carrying and supplying a stream of product items in a defined orientation along an infeed main path to a transfer position;

an elevator means comprising a plurality of stack-forming receptacles each receiving a grouped row of a specified number of said product items in a chopped manner from the transfer position of said supply line at an input end of the elevator means, wherein the elevator means is adapted to successively displace the stacked grouped rows of product items in a side-by-side relationship orthogonally to the infeed main path to an output end of the elevator means; and an outfeed unit engaging with the elevator means, commonly removing a specified number of stacked grouped rows of said product items in the side-by-side relationship from the output end of the elevator means to form said bundle of product items;

wherein the outfeed unit further comprises a plurality of first pusher blades being equidistantly attached to an endless conveyor belt and successively engaging the elevator means at the output end to take over and remove the specified number of layered or stacked grouped rows of the product items from the elevator means;

wherein the outfeed unit further comprises second pusher blades each forming a compartment together with each of said first pusher blades for accommodating said specified number of layered or stacked grouped rows of the product items during removal from the elevator means;

wherein the first and second pusher blades comprise mutual distance (d), adjustable to adapt same to the specific number of product items grouped in one row;

wherein the first and second pusher blades are each attached to first and second endless conveyor belts which are arranged in a colinear configuration on a common drive unit and which are displaceable relative to each other to adapt the mutual distance (d) between each of the first and second pusher blade.

2. Packaging device according to claim 1, for supplying a grouped row of product items in a chopped manner from the transfer position to the respective receptacle of the elevator means further comprising an infeed assembly at the end of the supply line comprising an infeed conveyor belt to transport the grouped row of product items into the respective receptacle of the elevator means, which infeed conveyor belt is controlled by a stepper motor, located above the infeed main path and advancable against the row of product items to bias the row of products from above against the main conveyor belt at least during the transport of the grouped row of product items, and further comprising a stopper means engagable into the infeed main path to hold and release the grouped row of product items in and from the transfer position at the end of the supply line in a manner synchronized with the infeed conveyor belt and the elevator means.

3. Packaging device according to claim 1, further comprising a separate adjustable stop for an abutment of the grouped row of product items, when being infed into the elevator means by the infeed conveyor belt, is provided in the elevator means.

4. Packaging device according to claim 1, wherein the elevator means comprises two parallel, spaced-apart endless conveyor units each with a plurality of horizontal, equidistantly arranged rails, a pair of each defining one of the receptacles for each grouped row of product items being infed from the transfer position.

5. Supply device, comprising a main conveyor belt constituently carrying and supplying a stream of product items in a defined orientation along an infeed main path to a transfer position for supplying a grouped row of product items in a chopped manner from the transfer position to a following stage, an infeed assembly at the end of the supply line comprising:

an infeed conveyor belt to transport the grouped row of product items, which infeed conveyor belt is controlled by a stepper motor, is located above the infeed main path and is advancable against the row of product items to bias the row of product items from above against the main conveyor belt at least during the transport of the grouped row of product items, and a stopper means engagable into the infeed main path to hold and release the grouped row of product items in and from the transfer position at the end of the supply line in a manner synchronized with the infeed conveyor belt;

wherein, when advancing the infeed conveyor belt against the row of product items, the infeed assembly further comprises an advancable downholder bar located above the infeed conveyor belt.

6. Supply device according to claim 5, wherein, when advancing the infeed conveyor belt against the row of product items, the infeed assembly further comprises an advancable downholder bar located above the infeed conveyor belt.

7. Supply device according to claim 5, wherein the infeed conveyor belt and the main conveyor belt idle when the stopper means holds the grouped row of product items in the transfer position.

8. Supply device according to claim 5, wherein the infeed conveyor belt and the main conveyor belt are driven simultaneously by a common stepper motor drive.

9. Supply device according to claim 5, further comprising laterally displaceable, tong-like clamping plates adjacent the infeed main path as the stopper means in the transfer position.

* * * * *

UNITED STATES PATENT AND TRADEMARK OFFICE

CERTIFICATE OF CORRECTION

PATENT NO. : 7,740,123 B2
APPLICATION NO. : 12/105715
DATED : June 22, 2010
INVENTOR(S) : Marion Janet López Fernández It is certified that error appears in the above-identified patent and that said Letters Patent is hereby corrected as shown below:

In Col. 5, line 67, the number "34" should be 34, 35

Signed and Sealed this
Twenty-eighth Day of December, 2010

David J. Kappos

David J. Kappos
*Director of the United States Patent and Trademark Office*